US006518935B2

(12) United States Patent
Louzir et al.

(10) Patent No.: US 6,518,935 B2
(45) Date of Patent: Feb. 11, 2003

(54) DEVICE FOR TRANSMITTING AND/OR RECEIVING ELECTROMAGNETIC WAVES FED FROM AN ARRAY PRODUCED IN MICROSTRIP TECHNOLOGY

(75) Inventors: Ali Louzir, Rennes (FR); Philippe Minard, Rennes (FR); Jean-François Pintos, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/894,398

(22) Filed: Jun. 28, 2001

(65) Prior Publication Data

US 2002/0080071 A1 Jun. 27, 2002

(30) Foreign Application Priority Data

Jun. 29, 2000 (FR) ..... 0008364

(51) Int. Cl.[7] ..... H01Q 21/00

(52) U.S. Cl. ..... 343/853; 343/700 MS; 343/824

(58) Field of Search ..... 343/700 MS, 795, 343/853, 893, 909, 824

(56) References Cited

U.S. PATENT DOCUMENTS 3,936,835 A * 2/1976 Phelan ..... 343/753
5,563,613 A 10/1996 Schroeder et al. ..... 343/700
5,777,584 A * 7/1998 Rothe ..... 343/700 MS
5,790,078 A * 8/1998 Suzuki et al. ..... 343/700 MS
5,945,951 A 8/1999 Monte et al. ..... 343/700
6,002,370 A * 12/1999 Mckinnon et al. ... 343/700 MS
6,031,491 A * 2/2000 Daniel et al. ..... 343/700 MS
6,285,323 B1 * 9/2001 Frank ..... 343/700 MS

OTHER PUBLICATIONS

Legay et al. "Resonant feeding networks for microstrip antennas" Proceedings of the Antennas and Propagation Society International Symposium, US, New York, IEEE, Jun. 28, 1993, pp. 1216–1219.

Kittenplon, "Surface–Wave Effect in a Wideband Aperture–Coupled Stacked Microstrip Antenna Array" Electronics Letters, GB, IEEE Stevenage, vol. 32, no. 9, Apr. 25, 1996, pp. 792–793.

French Search Report citing the above–listed documents: AA, AB, AI and AJ.

* cited by examiner

*Primary Examiner*—Don Wong
*Assistant Examiner*—Shih-Chao Chen
(74) *Attorney, Agent, or Firm*—Joseph S. Tripoli; Kuniyuki Akiyama

(57) ABSTRACT

The present invention relates to a device for transmitting and/or receiving electromagnetic waves comprising at least one antenna with at least one radiating element transmitting and/or receiving signals of given polarization and a feed array produced in microstrip technology consisting of lines devised so as to give parasitic radiation. In this case, the feed array is devised and dimensioned in such a way that the parasitic radiation has the same direction and the same polarization as the radiation of the antenna and combines in-phase with the said radiation of the antenna.

8 Claims, 4 Drawing Sheets

DEVICE FOR TRANSMITTING AND/OR RECEIVING ELECTROMAGNETIC WAVES FED FROM AN ARRAY PRODUCED IN MICROSTRIP TECHNOLOGY

FIELD OF THE INVENTION

The present invention relates to a device for transmitting and/or receiving electromagnetic waves, more particularly to an antenna known by the expression "printed antenna" fed from an array produced in mircostrip technology.

Hereinbelow, the expression "printed antenna" (or "microstrip antenna") will refer to an antenna produced in so-called "microstrip" technology, comprising a radiating element, typically a "patch", a slot, a dipole, etc., or an array of such elements, the number of elements depending on the desired gain. This type of antenna is used as primary source at the focus of a lens or of a parabola or as a planar array antenna.

BACKGROUND OF THE INVENTION

In printed antennas, the radiating elements, be they unitary or grouped into an array, are fed from a feed array formed of microstrip lines. In general, this feed array radiates, to a greater or lesser extent, undesired radiation or parasitic radiation which disturbs the main radiation of the antenna. The principal effects resulting from this parasitic radiation are a rise in the cross-polarization of the printed antenna. Other undesirable effects, which are more or less significant, may also result from this parasitic radiation, namely:

- an impairment of the radiation pattern of the antenna with a rise in the side lobes and/or a deformation of the main lobe,
- an impairment of the efficiency of the antenna, namely radiation losses.

Current solutions attempt to limit or minimize the parasitic radiation:

- through a judicious choice of the parameters of the dielectric substrate such as the thickness, permittivity, etc.,
- by optimizing the line widths,
- or by minimizing the discontinuities from which the parasitic radiations stem.

However, all the solutions proposed hitherto require compromises which limit their effectiveness. For example, a slender substrate exhibiting a high dielectric permittivity minimizes the radiation of the feed lines but also reduces the effectiveness of the radiation of the radiating elements and hence the efficiency of the antenna. Likewise, the use of narrow lines reduces the parasitic radiation but the smaller the widths of the lines, the larger the ohmic losses.

BRIEF SUMMARY OF THE INVENTION

Consequently, the aim of the present invention is to propose a solution which, instead of reducing the harmful effects of the parasitic radiation, uses them to contribute to the main radiation of the antenna.

A subject of the present invention is therefore a device for transmitting and/or receiving electromagnetic waves comprising an antenna with at least one radiating element transmitting and/or receiving signals of given polarization and a feed array produced in microstrip technology consisting of lines devised so as to give parasitic radiation, characterized in that the feed array is devised and dimensioned in such a way that the parasitic radiation has the same direction and the same polarization as the radiation of the antenna and combines in-phase with the said radiation of the antenna.

In a known manner the parasitic radiation is generated by discontinuities in the lines of the feed array, such as elbows, T circuits, line width variations.

In accordance with one embodiment of the present invention, the relative phase of the source of parasitic radiation is determined by the length of the lines of the feed array. Preferably, the feed array is a symmetrical array.

In the case of a linearly polarized antenna, the lengths of lines Li on each side of an elbow are given by the following equations:

$$L1=\lambda 1/2+k1\lambda 1 \quad k1=0,1,2,\ldots$$

$$L2=k2\lambda 2 \quad k2=0,1,2,\ldots$$

where $\lambda i$ represents the wavelength guided in the line of the feed array of length Li with:

$\lambda i=30/(f\sqrt{\epsilon r\ eff})$ [in cm]

with f: working frequency [in GHz]

$\epsilon r$ eff: effective permittivity of the material for the portion of line of length Li.

Moreover, in the case of a circularly polarized antenna comprising at least two radiating elements, the lengths of lines Li of the feed array formed of a T circuit with two elbows are given by the following equations:

$$L'2=L2+k1\lambda 2/4 \quad k1=1,2,3$$

where L'2 and L2 are the two branches of the T.

$$L'3=L3+k2\lambda 3/4 \quad k2=1,2,3$$

where L3 and L'3 are the lines connecting to the radiating elements.

BRIEF DESCRIPTION OF THE DRAWINGS

Other characteristics and advantages of the present invention will become apparent on reading the description of various embodiments, this description being given with reference to the appended drawings in which.

DESCRIPTION OF PREFERRED EMBODIMENTS

To simplify the description, in the figures the same elements bear the same references.

Moreover, the present invention will be described whilst referring to a printed antenna whose radiating elements consist of patches. However, it is obvious to the person skilled in the art that the present invention may be applied to any other type of printed antenna whose radiating elements are connected to a feed array produced in microstrip technology.

Figure 1:
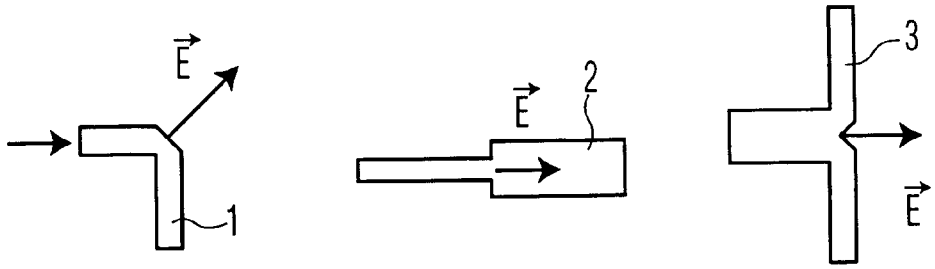
FIG. 1 PRIOR ART
FIG. 1 is a diagrammatic plan view of the various discontinuities which the microstrip lines may have.

Represented in FIG. 1 are various types of discontinuities which may be produced in a feed array formed by lines according to microstrip technology. The reference 1 represents an elbowed line. The reference 2 represents a widthwise line jump and the reference 3 represents a T.

As described in particular in the reference "Handbook of Microstrip Antennas" edited by J. R. James & P. S. Hall, published by Peter Peregrinus Ltd., London, and more particularly in the introduction to Chapter 14 entitled "Microstrip Antenna Feeds", pages 815 to 817, it is known that the discontinuities in the feed lines such as represented in FIG. 1 give parasitic radiation. In accordance, in particular, with the thesis by M. EL. Haj Sleimen on "Studies of Millimeter Printed Antenna Arrays" carried out at the Laboratoire Antennes et Réseaux de Rennes in 1999, it is possible to give an estimate of the orientation of the main radiation of the discontinuities such as the elbow 1, the widthwise line jump 2 and the T 3. This field is referenced E in FIG. 1.

Figure 2:
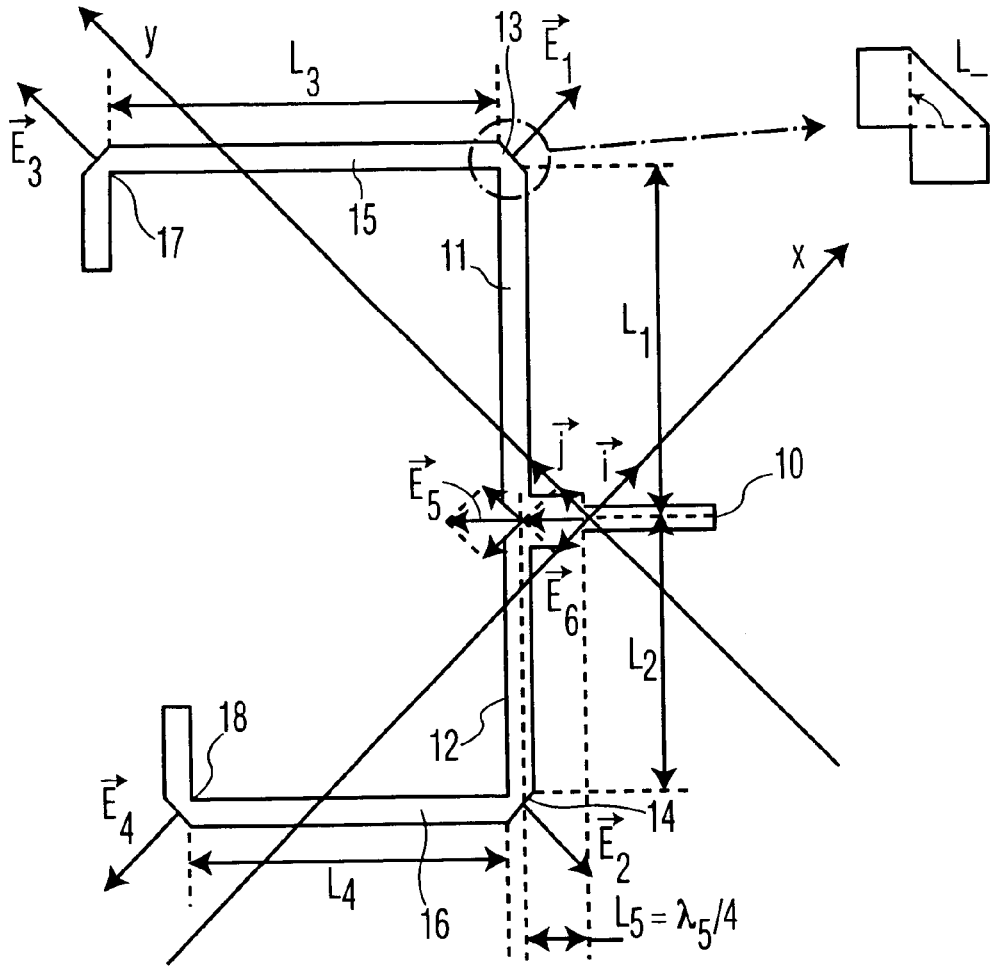
FIG. 2 PRIOR ART
FIG. 2 is a diagrammatic plan view of a feed array with the orientation of the E fields.

Represented in FIG. 2 is a feed array consisting of microstrip lines exhibiting a conventional structure. More particularly, this feed array comprises a T 10 extended by two branches 11, 12 of respective lengths L1 and L2. Each branch is extended by elbows 13, 14. The elbow 13 is extended by a line segment 15 of length L3 while elbow 14 is extended by a line segment 16 of length L4, the two line segments terminating in elbows 17,18. Moreover, the T 10 exhibits an increase in line width over a length L5 which is equal to λ5(?)/4 in the present case. As represented in FIG. 2, the various discontinuities exhibit parasitic radiation according to the field E1 for the elbow 13, the field E2 for the elbow 14, the field E3 for the elbow 17, the field E4 for the elbow 18, the field E5 for the T and the field E6 for the line broadening. From the six discontinuities E1 to E6 of the feed array identified in FIG. 2, it is possible to calculate the total field E generated by the feed array. Employing an orthonormal reference frame I,J, the unit vector of the fields E1 to E5 is therefore:

$$\overrightarrow{E_1}\begin{bmatrix}\overrightarrow{+i}\\ O\end{bmatrix},\quad \overrightarrow{E_2}\begin{bmatrix}O\\ \overrightarrow{-j}\end{bmatrix},\quad \overrightarrow{E_3}\begin{bmatrix}O\\ \overrightarrow{+j}\end{bmatrix},$$

$$E_4\begin{bmatrix}\overrightarrow{-i}\\ O\end{bmatrix},\quad \overrightarrow{E_5}\begin{bmatrix}\overrightarrow{-i}/\sqrt{2}\\ \overrightarrow{-j}/\sqrt{2}\end{bmatrix},\quad \overrightarrow{E_6}\begin{bmatrix}\overrightarrow{-i}/\sqrt{2}\\ \overrightarrow{-j}/\sqrt{2}\end{bmatrix},$$

In this case, for the calculation of total field E, the following parameters will be taken into account, namely:

- the effectiveness of the radiation of each of the discontinuities,
- the attenuation of the lines,
- and the power delivered by the feed at the level of each of the discontinuities.

By taking these elements into account, it is known practice to calculate the total field in a conventional manner. Then, the total field having been calculated, it is possible to determine the ellipticity of the parasitic radiation according to known methods which will not be described in the present application. In fact, on the basis of known equations, it may be seen that the relative phases of the parasitic radiation sources of the feed array are determined by the lengths L1, L2, L3, L4, L5, that their relative amplitudes depend on the nature of the discontinuity and are proportional to the relative power transported by the line experiencing the discontinuity. These radiation sources may be likened to a radiating array and the theory of arrays makes it possible, by knowing the location of the sources, their relative phase and their relative amplitude, to calculate the radiation pattern of this array and to determine, in particular, the polarization of the radiated field. Thus, to cause, in accordance with the present invention, the parasitic radiation to be in the same direction as the main radiation, to have the same polarization as the main radiation, and to combine in-phase with the main radiation, it is necessary for the phase centre of the source equivalent to the feed array to coincide with the phase centre of the array and for the radiation maximum to occur in the direction of the maximum of the main field, and for it to have the same polarization as the latter.

Figure 3:
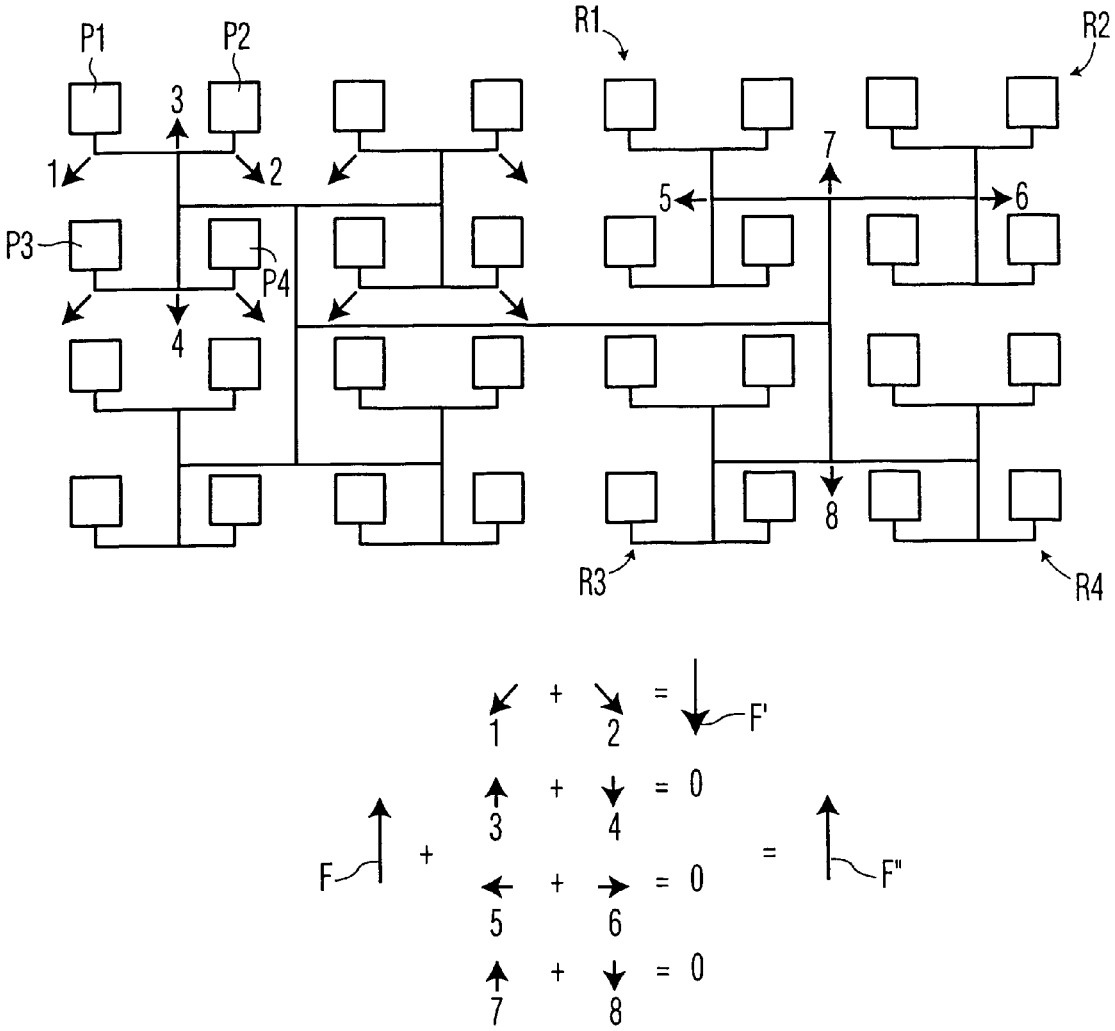
FIG. 3 PRIOR ART
FIG. 3 is a diagrammatic plan view of a printed antenna and of its feed array exhibiting parasitic radiation.

Thus, as represented in FIG. 3 which relates to a linearly polarized printed antenna, the parasitic radiation given by the elbows 1,2 has a resultant parallel to the main radiation. More specifically, the printed antenna of FIG. 3 consists of N arrays of four patches P1, P2, P3, P4, more particularly of eight arrays of four patches. As represented in FIG. 3, the four patches of a first array P1, P2, P3, P4 are connected symmetrically by a feed array comprising elbows 1,2 giving parasitic radiations 1,2 and T circuits giving parasitic radiations 3,4. Four arrays of four patches are connected together symmetrically, as represented in the right-hand part of FIG. 3, by T microstrip lines giving a parasitic radiation such as symbolized by the arrows 5, 6, 7 and 8. In this case, the main radiation together with the parasitic radiations can be symbolized as represented in the lower part of FIG. 3. The arrow F represents the main radiation to which is added the radiations of the elbows 1 and 2 which give a radiation F' in the same direction as the main radiation but of opposite sense, the radiations of the T circuits 3 and 4 which cancel one another out, 5 and 6 which cancel one another out and 7 and 8 which cancel one another out, in such a way as to obtain a resultant radiation parallel to the main radiation F but of lower amplitude. Thus, in the case of the printed antenna in FIG. 3 consisting of eight arrays of four patches symmetrically connected, if the conditions relating to the direction of the parasitic radiation and to the polarization of this parasitic radiation are fulfilled, the condition concerning the phase is not fulfilled. Thus, if the radiation is not controlled in-phase, it may partially or totally oppose the main radiation of the antenna and hence reduce its efficiency. To ensure maximum efficiency of the antenna, in accordance with the present invention, and as represented in FIG. 4, it is necessary to ensure that the parasitic radiation combines in-phase with the main radiation.

Figure 4:
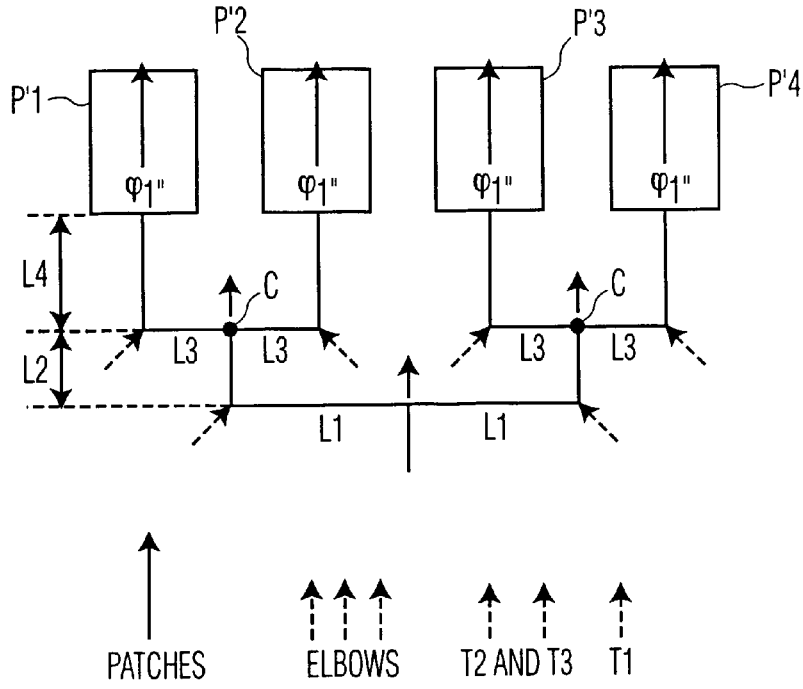
FIG. 4 is a diagrammatic plan view of a feed array according to the present invention in the case of linear polarization.

As represented in FIG. 4, the four patches P'1, P'2, P'3, P'4 giving a main radiation Φ1 are connected by a feed array comprising elbows and T circuits. More specifically, the patches P'1 and P'2 are linked together by a T feed circuit comprising two branches of identical length $L_3$ extended by an elbow linked by way of an identical length of line $L_4$ to the patches P'1, P'2. The patches P'3 and P'4 are connected in an identical manner, the two T feed circuits being linked together by another T feed circuit comprising two identical branches of length $L_1$ extended by elbows linked to the point C of the first T elements by line elements of identical length $L_2$.

To obtain parasitic radiation which combines in-phase with the main radiation in the case of linear polarization, as represented in FIG. 4, the lengths $L_i$ given above must obey the following rules:

$$L_1=\lambda_1/2+k_1\lambda_1 \quad k_1=0,1,2, \ldots$$

$$L_2=k_2\lambda_2 k_2=0,1,2, \ldots$$

$$L_3=\lambda_3/2=k_3\lambda_3 \quad k_3=0,1,2, \ldots$$

$$L_4=k_4\lambda_4 \quad k_4=0,1,2, \ldots$$

where $\lambda_i$ represents the wavelength guided in the portion of the feed array of length $L_i$; i.e. $\lambda_i$ $30/f\sqrt{\epsilon_{\text{reff}}}$ (in cm)

where f=working frequency (in GHz)

$(\epsilon_{reff})$=effective permittivity of the material for the line portion of length $L_i$.

Taking as phase reference the phase of the wave at the junction point of the first T, if the length L1 is such that $L_1=\lambda_1/2+k_1\lambda_1$ $k_1=0,1,2, \ldots$, the phase $\phi$ of the wave at the level of the first elbow would be 180° ($\phi=2\pi L1/\lambda_1=\pi+2k_1\pi$) and the field radiated by the elbow (shown dotted in the Figure) would have a sense represented in the figure. Thus, by summing the two elbow discontinuities on either side of the first T, the total field emanating from these two discontinuities adds constructively with the field radiated by the T discontinuity (represented as a continuous line in the figure). If L1 had been equal $k_1\lambda_1$, the fields radiated by the elbows would have opposite senses to those represented in the Figure, and their resultant would directly oppose the field radiated by the T, reducing the gain of the antenna, etc.

Figure 5:
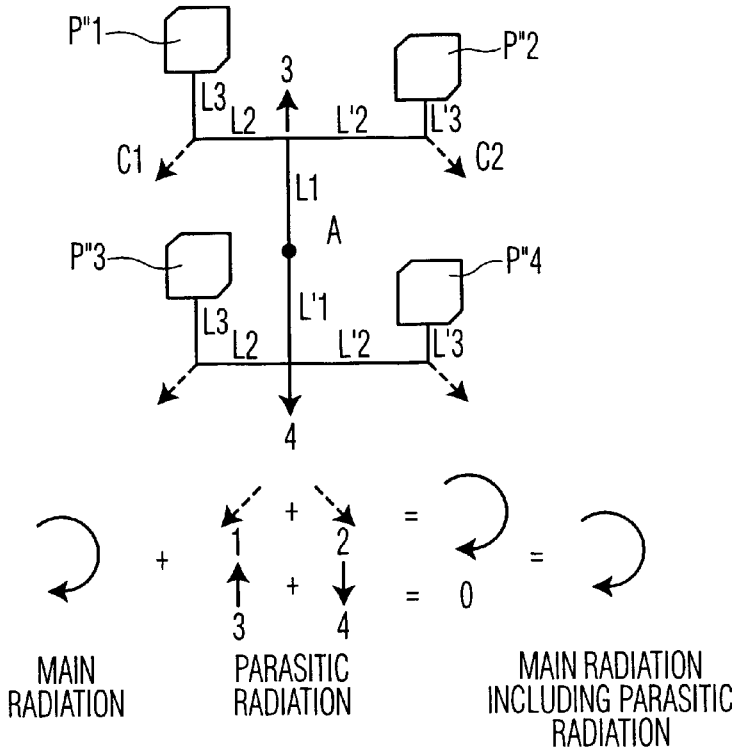
FIG. 5 is a diagrammatic plan view of a feed array according to the present invention in the case of circular polarization.

An embodiment of the present invention relating to the case of circular polarization will now be described with reference to FIG. 5. In this case, the printed antenna consists of an array of four patches P"1, P"2, P"3, P"4 connected to a feed array produced in microstrip technology, the feed array consisting of two T circuits linked together. More specifically, the first T circuit comprises two branches of length L2 and L'2, extended by elbows C1,C2, the elbow C1 being linked respectively to the patch P"1 by a length of line L3 and the elbow C2 to the patch P"2 by a length of line L'3. Likewise, the patches P"3 and P"4. Moreover, the two inputs of the T circuits are connected together at a common point A by lengths of line L1 and L'1. As represented in the bottom part of FIG. 5, the assembly of patches P"1, P"2, P"3, P"4 gives circularly polarized main radiation to which is added, on account of the elbows C1,C2 and of the T circuits 3,4, parasitic radiation, likewise circularly polarized and having the same sense as the polarization of the main radiation. Hence, a total radiation consisting of the main radiation to which the parasitic radiation is added is obtained. In order for the phase relation to be satisfied, the various lengths must be such that:

$$L_1=L'_1$$

$$L'_2=L_{2+}k_1\lambda_2/4 \quad k_1=1,2,3, \ldots$$

$$L_3=L'_3+k_{2\lambda 3}/4 \quad k_2_1,2,3, \ldots$$

$\lambda_i$ representing the wavelength guided in the part of the feed array of length $L_i$, as defined hereinabove.

Figure 6A:
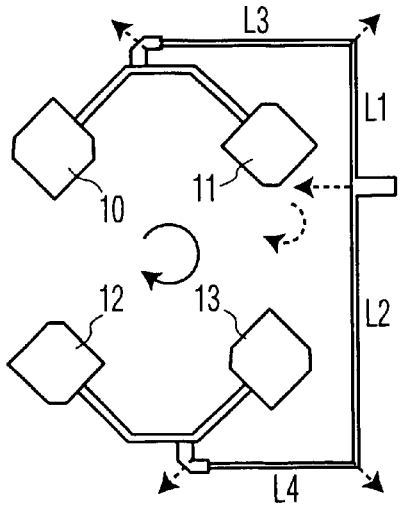
FIGS. 6*a* and 6*b* are diagrammatic plan views of a feed array with four patches respectively with parasitic radiation having the same polarization as the main radiation or having polarization inverse to that of the main radiation.
Figure 6B:
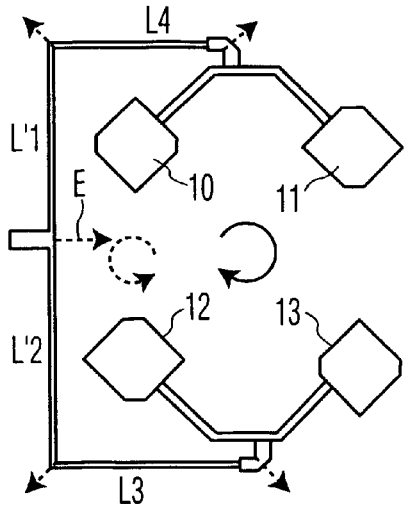

Represented in FIGS. 6*a* and 6*b* is a printed antenna consisting of an array of four patches 10, 11, 12, 13 connected to a feed circuit using the principle of sequential rotation. This antenna can serve for the illumination of a parabolic antenna or of an antenna of the Luneberg lens type. These four patches 10, 11, 12, 13 are fed from a feed array consisting, respectively for FIG. 6*a*, of lines of length L1, L2, L3, L4, the lines L1 and L2 forming the two branches of a T circuit, the line L1 being connected to the line L3 by an elbow, the line L2 being connected to the line L4 by an elbow, the line L3 being connected to the two patches 10 and 11 by another elbow and the line L4 being connected to the two patches 12 and 13 by yet another elbow. The T circuit and the four elbows give parasitic radiation with circular polarization whose sense is identical to that of the polarization of the main radiation.

Figure 7:
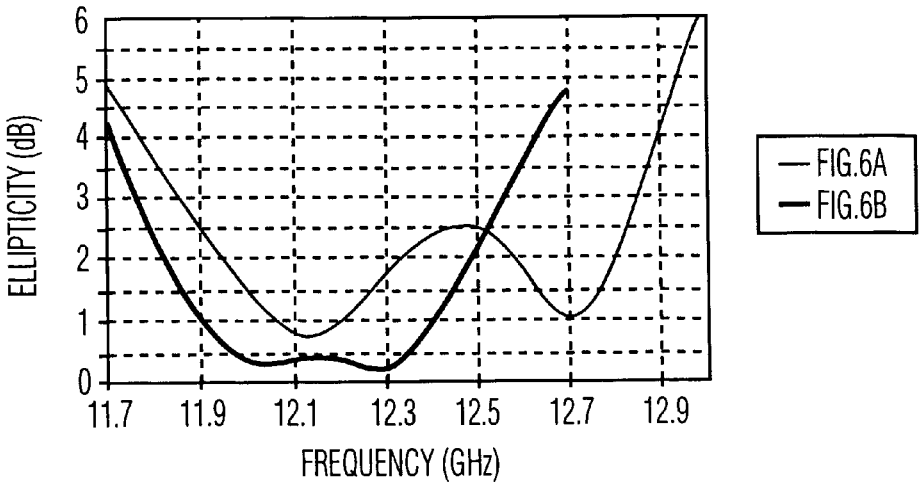
FIG. 7 represents the ellipticity in the case of the arrays of FIGS. 6*a* and 6*b*.

In FIG. 6*b*, the feed array has been modified in such a way that the two branches of the T circuit are of length L'1 and L'2, so as to give parasitic radiation symbolized by the arrow E which, by adding to the parasitic radiation of the elbows, gives parasitic radiation with circular polarization but of opposite sense to that of the main radiation. In this case, as represented in FIG. 7, the ellipticity (TE) as a function of frequency, obtained for the two arrays, shows one of the advantages of the present invention. For the circuit of FIG. 6*b*, the TE is less than 1.74 dB over a frequency band of 630 MHz. For FIG. 6*a*, the TE is less than 1.74 dB over two bands, one of 330 MHz centred at 12.1 GHz and the other at 150 MHz centred at 12.7 GHz. It may be seen in the chart that, at equivalent TE level (3 dB), this represents an increase in bandwidth of TE of 40% for the circuit in accordance with the present invention.

With the present invention, the following advantages are obtained:

improvement in the efficiency of the antenna, no contradictory choices to be made both in respect of the substrate and in respect of the design of the antenna, in the case of circular polarization, in particular, the level of cross-polarization is very low.

What is claimed is:

1. Device for transmitting and/or receiving electromagnetic waves comprising at least one antenna with at least one radiating element transmitting and/or receiving signals of given polarization and a feed array produced in microstrip technology consisting of lines comprising bends giving parasitic radiation wherein in the case of a linearly polarized antenna, the lengths of lines Li (i=1,2) on each side of a bend are given by the following equations:

$$L1=\lambda½+k1\lambda 1 \quad k1=0,1,2, \ldots$$

$$L2=k2\lambda 2 \quad k2=0,1,2, \ldots$$

where $\lambda i$ represents the wavelength guided in the line of the feed array of length Li with:

$\lambda i=30/(f\sqrt{\epsilon r \text{ eff}})$ with f: working frequency $\epsilon r$ eff: effective permittivity of the material for the portion of line of length Li.

2. Device according to claim 1, characterized in that the parasitic radiation is generated by discontinuities in the lines of the feed array, such as elbows, T circuits, line width variations.

3. Device according to claim 1, characterized in that the relative phase of the source of parasitic radiation is determined by the length of the lines of the feed array.

4. Device according to claim 1, characterized in that the feed array is a symmetrical array.

5. Device for transmitting and/or receiving electromagnetic waves comprising at least one antenna with at least one radiating element transmitting and/or receiving signals of given polarization and a feed array produced in microstrip technology consisting of lines comprising bends giving parasitic radiation wherein in the case of a circularly polarized antenna, comprising at least two radiating elements, the lengths of lines Li (i=1,2), L'i (i=1,2) of the feed array formed of a T circuit with two bends are given by the following equations:

$$L'2=L2+k1\lambda 2/4k1=1,2,3$$

where L'2 and L2 are the two branches of the T;

$$L'3=L3+k2\lambda 3/4k2=1,2,3$$

where L3 and L'3 are the lines connecting to the radiating elements, where λi represents the wavelength guided in the line of the feed array of length Li with:

$\lambda i=30/(f\sqrt{\epsilon reff})$ with f: working frequency

εreff: effective permittivity of the material for the portion of line of length Li, L'i.

6. Device according to claim 5, wherein the feed array is a symmetrical array.

7. Device according to claim 5, wherein the parasitic radiation is generated by discontinuities in the lines of the feed array, such as elbows, T circuits, line width variations.

8. Device according to claim 5, wherein the relative phase of the source of parasitic radiation is determined by the length of the lines of the feed array.

* * * * *